United States Patent [19]

Herzberg

[11] Patent Number: 4,966,140

[45] Date of Patent: Oct. 30, 1990

[54] PROTECTIVE FACIAL MASK

[75] Inventor: Wolfgang Herzberg, Wedel/Holstein, Fed. Rep. of Germany

[73] Assignee: Renate Dunsch-Herzberg, Wedel/Holstein, Fed. Rep. of Germany

[21] Appl. No.: 231,299

[22] Filed: Aug. 11, 1988

[30] Foreign Application Priority Data

Jul. 27, 1988 [DE] Fed. Rep. of Germany ... 8809551[U]

[51] Int. Cl.[5] ..... A62B 7/00

[52] U.S. Cl. ..... 128/206.19; 128/206.12; 128/206.14; 128/306.21; 128/206.24; 128/206.25; 128/206.28; 128/206.13; 2/9; 2/206; 2/DIG. 7

[58] Field of Search ..... 2/202, 9, 206; 128/1 R, 128/97, 163, 206.12, 206.13, 206.14, 206.19, 206.11, 206.24, 206.25, 206.28, 206.21, 206.23, 206.21, 206.26, 206.14

[56] References Cited

U.S. PATENT DOCUMENTS

| | | | |
|---|---|---|---|
| 1,097,530 | 5/1914 | Cabelinsky | 2/202 X |
| 1,139,675 | 5/1915 | Harns et al. | 2/203 |
| 1,200,528 | 10/1916 | Ryder | 2/203 |
| 1,251,657 | 1/1918 | Hart | 2/205 X |
| 1,800,051 | 4/1931 | Blanco | 2/206 |
| 2,374,643 | 5/1945 | Boettcher | 2/DIG. 7 X |
| 2,435,688 | 2/1948 | Lupo | 2/202 |
| 2,762,368 | 9/1956 | Bloomfield | 2/9 |
| 3,419,909 | 1/1969 | Spain | 2/174 |
| 3,602,913 | 9/1971 | Neese | 2/9 |
| 3,736,595 | 6/1973 | Siegmann | 2/DIG. 7 X |
| 3,768,100 | 10/1973 | Cotman et al. | 2/9 |
| 3,872,516 | 3/1975 | Bird et al. | 2/202 |
| 3,884,227 | 5/1975 | Lutz et al. | 128/206.19 |
| 3,885,558 | 5/1975 | Belkin | 128/142.7 |
| 3,943,575 | 3/1976 | Bolker | 2/DIG. 7 X |
| 4,055,173 | 10/1977 | Knab | 2/DIG. 7 X |
| 4,122,847 | 10/1978 | Craig | 2/15 X |
| 4,195,629 | 4/1980 | Halford | 128/206.13 |
| 4,250,577 | 2/1981 | Smith | 2/247 |
| 4,300,549 | 11/1981 | Parker | 128/206.12 X |
| 4,331,136 | 5/1982 | Russell et al. | 128/163 |
| 4,387,471 | 6/1983 | Hsu et al. | 2/DIG. 6 X |
| 4,411,023 | 10/1983 | Pinson | 2/205 X |
| 4,419,993 | 12/1983 | Petersen | D8/206.19 X |
| 4,464,797 | 8/1984 | Glassman | 2/199 |
| 4,467,799 | 8/1984 | Steinberg | 128/206.14 |
| 4,635,628 | 1/1987 | Hubbard et al. | 128/206.19 X |
| 4,653,124 | 3/1987 | McNeal et al. | 2/427 |
| 4,796,621 | 1/1989 | Barte et al. | D8/206.23 |

FOREIGN PATENT DOCUMENTS

| | | | |
|---|---|---|---|
| 0316291 | 5/1989 | European Pat. Off. | 2/9 |
| 155000 | 6/1938 | Fed. Rep. of Germany | 128/206.24 |
| 661740 | 6/1938 | Fed. Rep. of Germany | 128/206.24 |
| 873113 | 6/1942 | France | 128/206.24 |

*Primary Examiner*—Werner H. Schroeder
*Assistant Examiner*—Jeanette E. Chapman

[57] ABSTRACT

For the protection of the operating surgeon and of the medical staff when treating patients and during operations against the effects of secretions and blood of patients suffering from the immune deficiency disease AIDS, the facial mask consists of a mask blank with laterally attached fastening tapes, the mask blank of the facial mask being provided on the inside and on its upper edge, with a smooth or transversely folded relative to its longitudinal direction strip of foamed plastic with an adhesive surface of a coating with its self-adhesive agent, the adhesive layer being covered by means of a peelable protective sheet, so that the foamed plastic strip disposed on the upper edge of the mask blank of the facial mask which, facing the face, is provided with an adhesive layer and, due to its ready deformability, is, with its upper edge carrying the adhesive layer on the inside, made to adhere above the nasal area and onto the buccal region, so that a protection of the mouth and nose is ensured and the humid respiratory air cannot escape at the upper edge of the mask.

2 Claims, 2 Drawing Sheets

PROTECTIVE FACIAL MASK

BACKGROUND OF THE INVENTION

The present invention relates to a protective facial mask for the protection of the operating surgeon, the medical staff et al, against the effects of secretions and blood of patients suffering from the immune deficiency disease AIDS, consisting of a mask blank with laterally fitted fastening tapes.

Due to the spreading immune deficiency disease AIDS, the precautionary measures normally taken hitherto for protecting the medical staff are no longer sufficient. It is thus necessary, among other things, to protect the eyes of the medical staff against contact with secretions and blood of patients. The spectacles or goggles used for this purpose do fulfil their protective functions, it is true, but they do create a host of new problems:

Spectacles are objects tied to persons, which means that the respective owner is compelled to take care of and look after a further object. The change of clothing within operating areas is sufficiently known as the cause of loss of personal objects.

Even when carefully looked after, spectacles are by now means near-sterile objects, which means that, in an operation, the spectacles of the surgeon can become the cause of an infection.

A person not normally wearing glasses will only with difficulty acquire the knack of wearing them and, due to their being unfamiliar, said person will often not wear them.

The combination of a mouth mask and spectacles results in a misting over of the spectacle lenses, a problem which, also for the microscoping surgeon, had not been resolved up till now.

SUMMARY OF THE INVENTION

The present invention is based on the technical problem of providing a protective facial mask of the type stated in the beginning for the protection of the operating surgeon and of the medical staff against the effects of secretions and blood of patients suffering from the immune deficiency disease AIDS, with which not only an effective protection is provided, but in which the humid respiratory air cannot escape at the top edge or rim of the mask and which can be combined with a sight protection to form a disposable.

This technical problem is solved by a protective facial mask of the type described in the beginning in that the mask blank of the facial mask, on the inside and at its top edge, is provided with a smooth or, transversely to the longitudinal direction, folded strip of foamed plastic with an adhesion surface consisting of a coating of a self-adhesive agent, the adhesive layer being covered by means of a peelable protective sheet.

With such a construction, a facial mask is provided in which the humid respiratory air cannot escape at the upper edge of the mask. This is prevented by the foamed plastic strip arranged on the upper edge of the mask blank of the facial mask which, on the side turned toward the face, is provided with an adhesive layer so that, due to the easy deformability of the mask blank and its strip of foamed plastic, the mask blank is, with its upper edge carrying the adhesive layer on the inside, made to adhere to the facial area above the nose and onto the buccal area below the eyes so that a protection of the mouth and nose is ensured. If, in addition, the strip of foamed plastic also consists of a folded strip as well, then a molding onto the nasal and buccal area is possible. An airtight sealing on the upper edge of the facial mask relative to the nasal and buccal region is thus achieved. Furthermore, the facial mask can be combined with a sight protection to form a disposable.

The strip of foamed plastic arranged on the internal upper rim of the facial mask, which may also be constructed as a rubber/plastic folding strip and which is provided with a skin-compatible adhesive strip or with a coating of an adhesive, renders the airtight sealing of the upper edge of the facial mask against the facial skin possible.

According to a further embodiment of the invention, a highly transparent, flexible plastic sheet having very poor reflection properties is stitched or bonded onto the outside on the upper edge of the facial mask. In its dimensions this generously covers the eyes and parts of the forehead. At the same time, the plastic sheet should fit tightly against the forehead in order to largely prevent incident light from the top from becoming effective in the form of annoying reflections. In this case it is advantageous to slightly angle the upper rim of the plastic sheet in the direction toward the facial skin.

The invention furthermore provides a facial mask with a hood for the head which is designed as a so-called astronaut's hood and which is detachably or firmly connected to the facial mask, the hood, on its outside, having a visor or peak-like blank firmly or detachably fastened on its upper edge as sight protection and as protection against reflections, the blank consisting of an opaque or delustered plastic sheet that is dyed black or some other dark color. This visor intende as protection against disturbing reflections is either stitched or bonded onto the disposable hood, e.g. of the astronaut type, or is separately placed around the forehead with a tape.

Advantageous developments of the invention are characterized in the subclaims.

BRIEF DESCRIPTION OF THE DRAWINGS

Embodiments of the invention are explained in detail below with the aid of the drawings.

DETAILED DESCRIPTION OF THE PREFERRED EMBODIMENT

Figure 1:
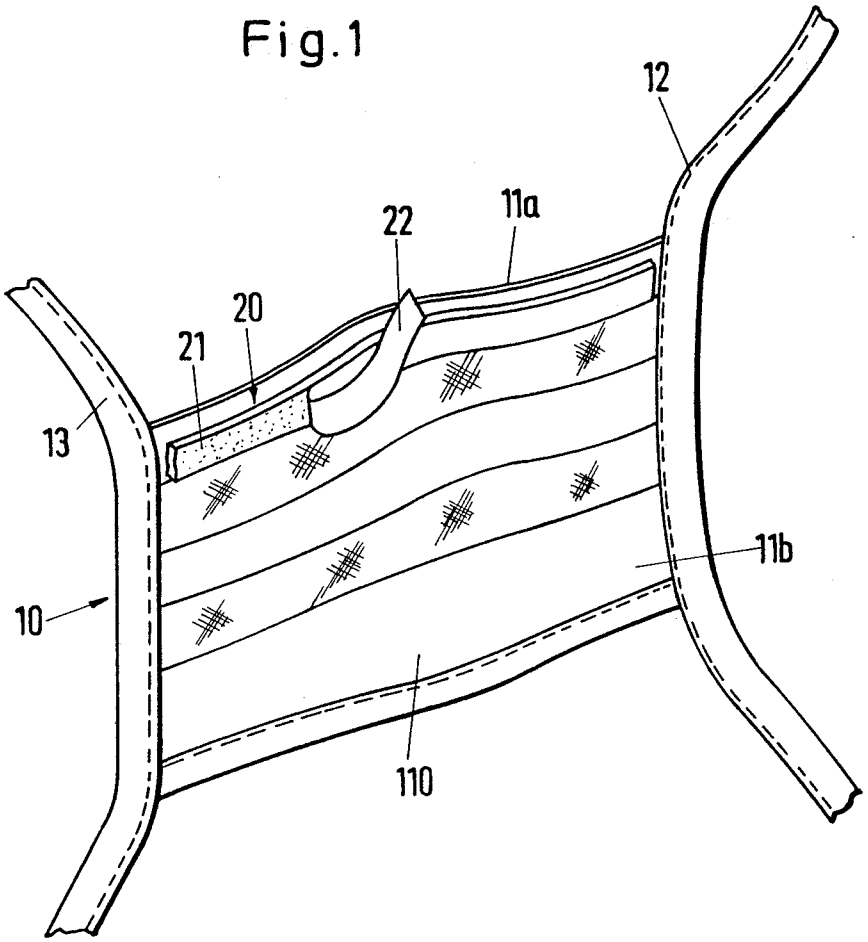
FIG. 1 shows, in a diagrammatical view, a facial mask with its foamed plastic strip fitted on its mask blank.

The protective facial mask depicted in FIG. 1 and identified by 10 is constructed in a manner known per se and consists of a mask blank 110 which, on its opposed edge areas, carries one fastening tape 12,13 each. The mask blank 110 itself consists of a fabric of a suitable woven cloth or the like. The upper edge of the mask blank 110 is identified by **11*a* and the inside of the mask blank 110 by 11*b***.

Adjacent to its upper edge **11*a*, the mask blank 110 is provided with a plastic foam strip 20 on its inside 11*b*, said strip being provided with an adhesive surface indicated at 21, which consists of a coating with a self-adhesive agent. This adhesive layer 21 is covered by means of a peelable protective sheet 22**.

All suitable foamed plastics may be employed as material for the strip 20. If the facial mask 10 is put on, then the protective sheet 22 is first pulled off from the foamed plastic strip 20 and the upper edge 11*a* of the mask blank 110 with its foamed plastic strip 20 is pressed against the facial skin, as a consequence of which the adhesive layer is pressed onto the skin of the face above the nose and in the buccal areas underneath the eyes, whereby an airtight sealing against the facial skin is obtained.

Figure 4:
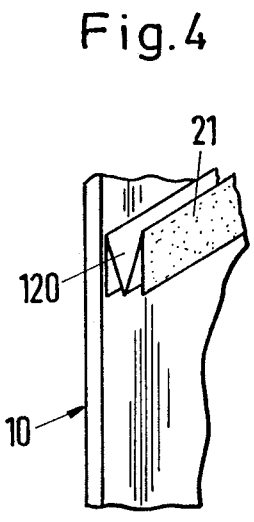
FIG. 4 shows, in a diagrammatical view, a section of the mask blank with a folding strip.
Figure 3:
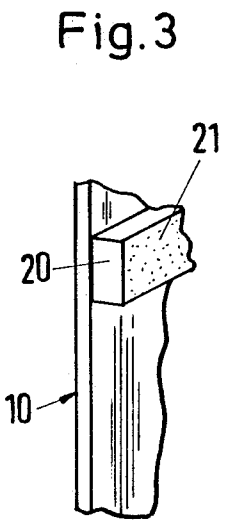
FIG. 3 shows, in a diagrammatical view, a section of the mask blank with the strip of foamed plastic.

Besides the use of a smooth foamed plastic strip 20 according to FIG. 3, there also exists the possibility of using a folding or folded strip 120 according to FIG. 4 which likewise consists of foamed plastics or other suitable resilient-elastic plastics, particularly soft ones.

Figure 2:
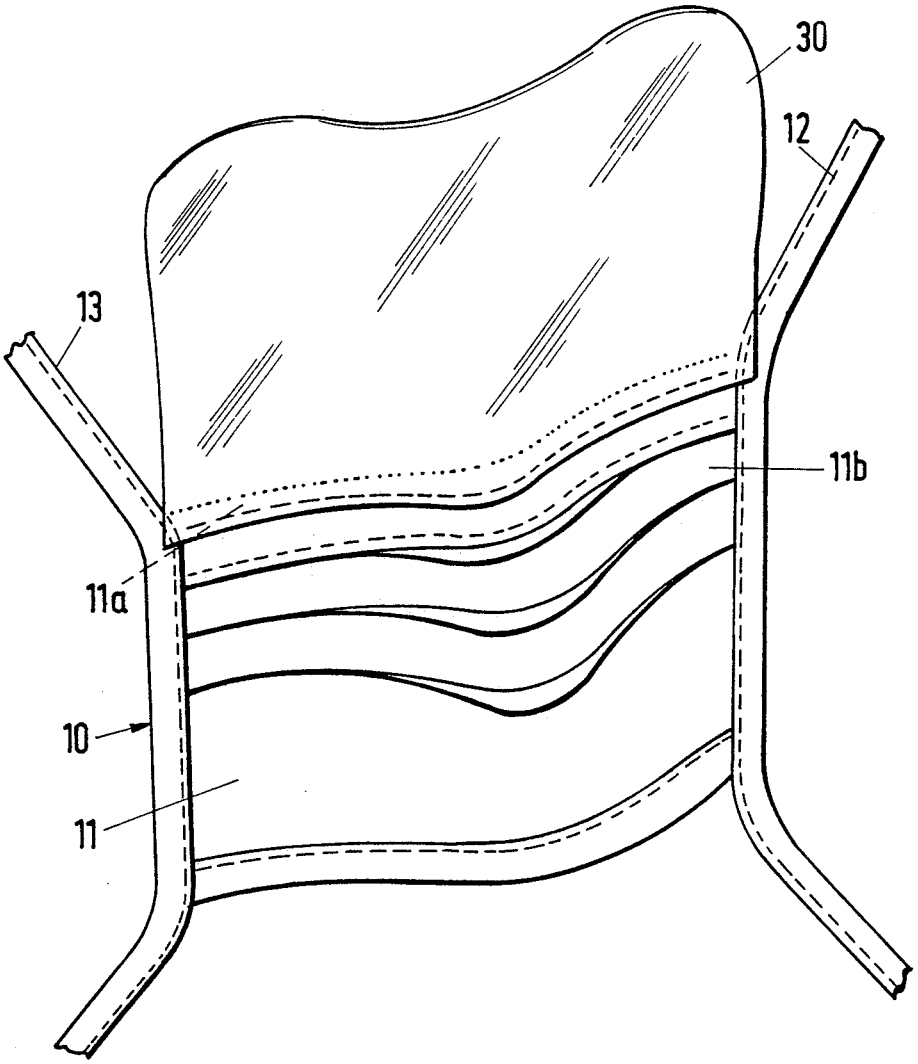
FIG. 2 shows, in a diagrammatical view, the facial mask with the sight area fitted on the upper edge of its mask blank.

The mask blank 110 of the facial mask 10 possesses on the outside and on its upper edge 11*a*, a plastic sheet blank 30 serving as viewing area which consists of a highly transparent, flexible plastic possessing poor reflection properties. This plastic sheet blank 30 is joined to the mask blank 110 of the facial mask 10 by means of a bonded or stitched connection and, in its dimensions, generously covers the eyes and parts of the forehead. In this case the sheet blank has to fit firmly to the forehead so as to largely prevent incident light from above from becoming effective in the form of annoying reflections (FIG. 2).

Figure 5:
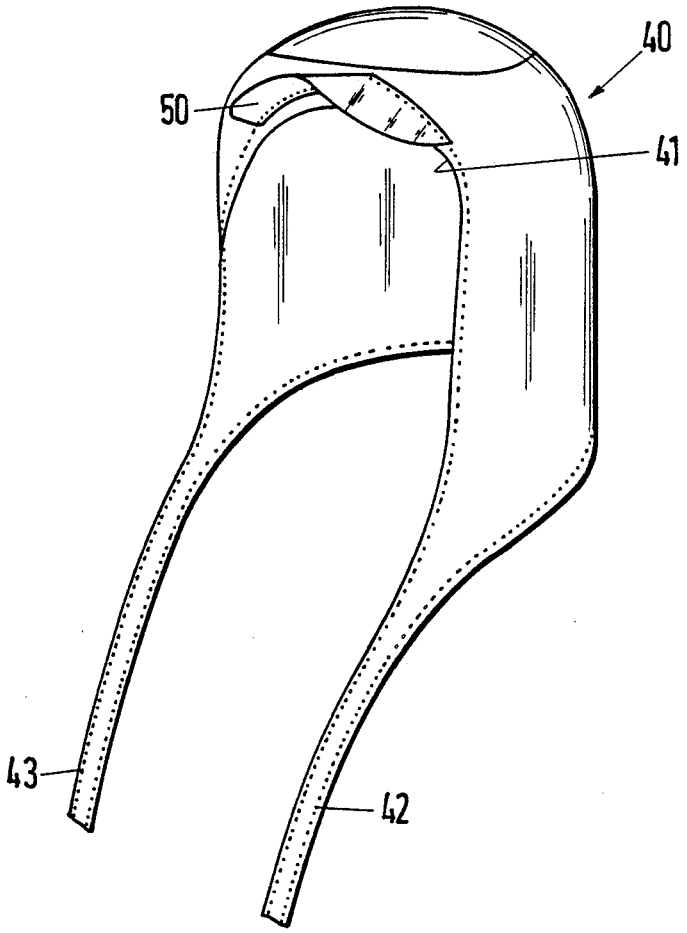
FIG. 5 shows, in a diagrammatical view, a disposable hood.

The facial mask 10 may also be used in connection with a hood for the head 40. Such a hood or disposable astronaut-type hood is shown in FIG. 5. In this case the facial mask 10 is detachably or firmy connected with the hood 40. The fastening tapes of the hood are identified by 42,43. If the facial mask 10 is firmly connected with the hood 40, then the hood 40 is put on by pulling it over the head. If, on the other hand, the facial mask 10 is detachably connected to the hood 40, in that case the facial mask 10 is fitted subsequent to the hood 40 having been put on and fastened. On the outside, on its upper edge 41, the hood 40 is provided with a visor or peak-like blank 50 as sight and reflection protection, this visor-like blank 50 may be attached firmly or detachably to the upper edge 41 of the hood 40. The visor-like blank 50 consists of an opaque or delustered plastic sheet which has been dyed black or some other dark color. The attachment of the visor-like blank 50 to the upper edge 41 of the hood 40 is effected by means of bonded or stitched connections when a firm connection is desired. If, however, the visor-like blank 50 is to be detachably connected with the hood 50, then the visor-like blank 50 is attached to the upper edge 41 of the hood 40 by means of a Velcro fastener constructed in a manner known per se. This fastener consists of two parts which are produced and fitted according to a special process and of which the one part is attached to the visor-like blank 50 and the other part to the upper edge 41 of the hood 40. One part consists of a coating of minute barbs while the other part is provided with a fluffy or fleecy layer of fibers, so that the tiny barbs remain clinging firmly to this fleecy fiber layer when both parts, thus in this case the visor-like blank and the upper edge of the hood, are brought into connection with one another. If, on the added visor-like blank 50, a light pressure is brought to bear against the upper edge 41 of the hood 40, the upper edge 41 of the hood 40 being fitted with the fleecy fiber layer, while the visor-like blank is provided with the layer of tiny barbs, said tiny barbs engage into the fiber layer and hold both parts together, viz. visorlike blank and hood. This Velcro fastener is readily opened in that the visor-like blank 50 is then pulled off with a light tug from the upper rim 41 of the hood 40. The visor-like blank 50, too, may be provided with fastening tapes on its lateral terminal areas, whereby the possibility is provided of, after the hood having been donned, additionally affixing the visorlike blank.

The plastic sheet from which the blank 50 is fabricated posseses an adequate inherent rigidity in order to impart the visorlike configuration to the blank 50.

What is claimed is:

1. A facial mask for the protection of the operating surgeon, the medical staff et al. against the effects of secretions and blood of patients suffering from immune deficiency disease AIDS, comprising a mask with upper and lower marginal portions and laterally spaced side edge portions, substantially vertical fastening tapes along each side edge portion and a sealing strip formed along the upper marginal portion of the mask blank, the sealing strip extending continuously and substantially across the full extent of the upper marginal portion of the mask, and the strip comprising a highly flexible and compressible intermediate portion between an adhesive surface and the facial side of the mask and consisting of an elongated plastic member folded along longitudinal lines, the adhesive surface being coated with a pressure sensitive adhesive agent, and a peelable protective sheet over said pressure sensitive adhesive agent.

2. A facial mask for the protection of the operating surgeon, the medical staff et al. against the effects of secretions and blood of patients suffering from immune deficiency disease AIDS, comprising a mask with upper and lower marginal portions and laterally spaced side edge portions, substantially vertical fastening tapes along each side edge portion and a sealing strip formed along the upper marginal portion of the mask blank, the sealing strip extending continuously and substantially across the full extent of the upper marginal portion of the mask, and the strip comprising a highly flexible and compressible intermediate portion between an adhesive surface and the facial side of the mask and consisting of an elongated plastic member folded along longitudinal lines, the adhesive surface being coated with a pressure sensitive adhesive agent, a peelable protective sheet over said pressure sensitive adhesive agent, and a transparent plastic sheet comprising a viewing portion with dimensions to cover at least the eyes of the wearer, said sheet having poor light reflection characteristics and being joined to the mask at its lower edge portion and along the upper marginal portion of the mask.

* * * * *